US005305483A

United States Patent [19]

Watkins

[11] Patent Number: 5,305,483

[45] Date of Patent: Apr. 26, 1994

[54] INFANT BODY SUPPORT AND PROVIDING AIR FLOW FOR BREATHING

[76] Inventor: Charles E. Watkins, 3131 N. Druid Hills Rd., Apt 10303, Decatur, Ga. 30033

[21] Appl. No.: 27,815

[22] Filed: Mar. 8, 1993

[51] Int. Cl.[5] ..... A47G 9/00

[52] U.S. Cl. ..... 5/638; 5/469; 5/645; 5/910; 128/202.18

[58] Field of Search ..... 5/469, 468, 423, 284, 5/461, 636, 638, 453, 910, 645; 297/180; 128/202.18, 205.26, 716, 848; 600/22

[56] References Cited

U.S. PATENT DOCUMENTS

| | | | |
|---|---|---|---|
| 1,142,876 | 6/1915 | Davis et al. | 5/284 |
| 2,025,659 | 12/1935 | Gilquin | 5/642 |
| 2,059,226 | 11/1936 | Gates | 5/468 |
| 2,085,296 | 6/1937 | Carey | 5/481 |
| 2,493,067 | 1/1950 | Goldsmith | 5/423 |
| 2,512,559 | 6/1950 | Williams . | |
| 3,089,153 | 5/1963 | Bosc . | |
| 3,266,064 | 8/1966 | Figman | 5/469 |
| 3,486,177 | 12/1969 | Marshack | 5/469 |
| 3,644,950 | 2/1972 | Lindsay, Jr. | 5/469 |
| 3,681,797 | 8/1972 | Messner | 5/469 |
| 4,206,524 | 6/1980 | Cook | 5/468 |
| 4,391,009 | 7/1983 | Schild et al. | 5/469 |
| 4,694,521 | 9/1987 | Tominaga | 5/469 |
| 4,825,488 | 5/1989 | Bedford | 5/469 |
| 4,867,230 | 9/1989 | Voss | 5/284 |

FOREIGN PATENT DOCUMENTS

| | | | |
|---|---|---|---|
| 0491145 | 6/1992 | European Pat. Off. | 5/636 |
| 1391506 | 4/1975 | United Kingdom | 5/468 |

*Primary Examiner*—Alexander Grosz
*Attorney, Agent, or Firm*—Todd E. Marlette

[57] ABSTRACT

The present invention solves a possible contributing cause of Sudden Infant Death syndrome. A body support pad having a support portion and a pillow portion is disclosed. The support portion is connected to the pillow portion. The pillow portion provides ventilation to the infant. The pillow portion has a thin outer sheet permeable to the passage of air which keeps the head of the infant in healthy repose. The interior of the pillow is subdivided into an upper portion containing a porous foam material and a lower portion containing an air pocket. An air pump supplies air to the air pocket to thus supply air to the nose and mouth of the infant.

16 Claims, 1 Drawing Sheet

INFANT BODY SUPPORT AND PROVIDING AIR FLOW FOR BREATHING

BACKGROUND OF THE INVENTION

The present invention pertains to a body support pad, and more particularly to a pillow for supplying a sufficient amount of air passage to and from an infant lying thereon.

A leading cause of deaths nationally among infants from two weeks to one year of age has become known as Sudden Infant Death Syndrome. Medical researchers nationally have spent the past decades trying and failing to unravel the cause of the death of such a significant number of infants. The majority of the studies conducted found that the infants that are usually found dead are particularly newly born, premature and twins. However, the cause of the death of these infants is frustrating because numerous instances exist where a parent has placed a normal healthy infant on its stomach in a crib or bed to only come back a short time later to find the infant dead.

The numerous studies that have been conducted and reported have only resulted in medical personnel advising parents to not place their infants face down on a crib or bed because this position seems to increase the risk of Sudden Infant Death Syndrome. For decades, these doctors, nurses and care guidebooks have advised placing infants on their back or side in the crib or bed. However, parents have been opposed to placing the infants in this position because of an infant's preference for sleeping on their stomachs and/or the infant's tendency to vomit. Further, the parents seem to believe that the risk is not as great as opposed to making the infants unhappy and sleepless by placing them into another position.

Applicant believes that a contributing cause of the death of infants results from an infant rebreathing carbon dioxide. This occurs from the fact the infants are placed on their stomachs and may be too weak to be able to move from this lying position. Accordingly, the infants rebreath the carbon dioxide that is trapped in the loose sheets held against the infant's face.

The present invention addresses the above problem and provides a solution to this possible contributing cause of Sudden Infant Death Syndrome. As this application was being prepared, more research is expected on the above problems, but researches and medical personnel have been unable to solve the mystery behind the sudden death of such a significant number of infants. Further, none of the references uncovered by Applicant's search recognizes or proposes solutions for the possible contributing causes of Sudden Infant Death Syndrome.

SUMMARY OF THE INVENTION

The present invention provides a means for solving a possible contributing cause of Sudden Infant Death Syndrome. Applicant solves this problem by providing an infant support pad that is both cost effective to manufacture and simple to use.

A body support pad having a body support portion and pillow portion, said body support portion comprising a covered foam padding support which is connected to said pillow portion, said pillow portion, providing breathing aid means for supporting the head of an infant, supplying breathing air near the mouth and nose of said infant, and providing ventilation to the portion of the skin of said infant in contact with said pillow portion, said pillow portion comprising:

a thin pliable outer sheet portion having a lower surface and sidewall surfaces which are relatively impermeable and having an upper support surface which is relatively permeable to the passage of air;

said outer sheet portion enclosing an interior volume of sufficient length and width to fully underlie said head of said infant even during infant tossing and turning, said interior volume also being of sufficient overall thickness to support said head of said infant in a position of healthy repose;

said enclosed interior volume being further subdivided into upper and lower portions, one above the other, with said upper portion being formed of a porous foam material and said lower portion being a void defining an air pocket bounded on the bottom and sides by said lower surface and sidewall surfaces of said thin pliable outer wall portion, and on the top by said sheet of porous foam material;

air pump means for supplying steady breathing air flow to said air pocket, wherein:

said steady breathing air flow to said air pocket causes air to flow past said nose and mouth of said infant without any effort on the part of the infant thus significantly reducing the probability of suffocation.

An object of the present invention is to provide a pillow portion for supplying a sufficient amount of air flow near the infant's face and nose.

Another object of the present invention to provide a pillow breathing device that includes a low pressure pump that will allow for pumping air out of the air pocket to cause a suction through the perforations in the outer sheet and foam pad so that any carbon dioxide laden air will be drawn away from the infant's face.

These and other objects and advantages will become apparent from the following description of a preferred embodiment of the invention taken together with the accompanying drawings.

DETAILED DESCRIPTION OF THE PREFERRED EMBODIMENT

Figure 1:
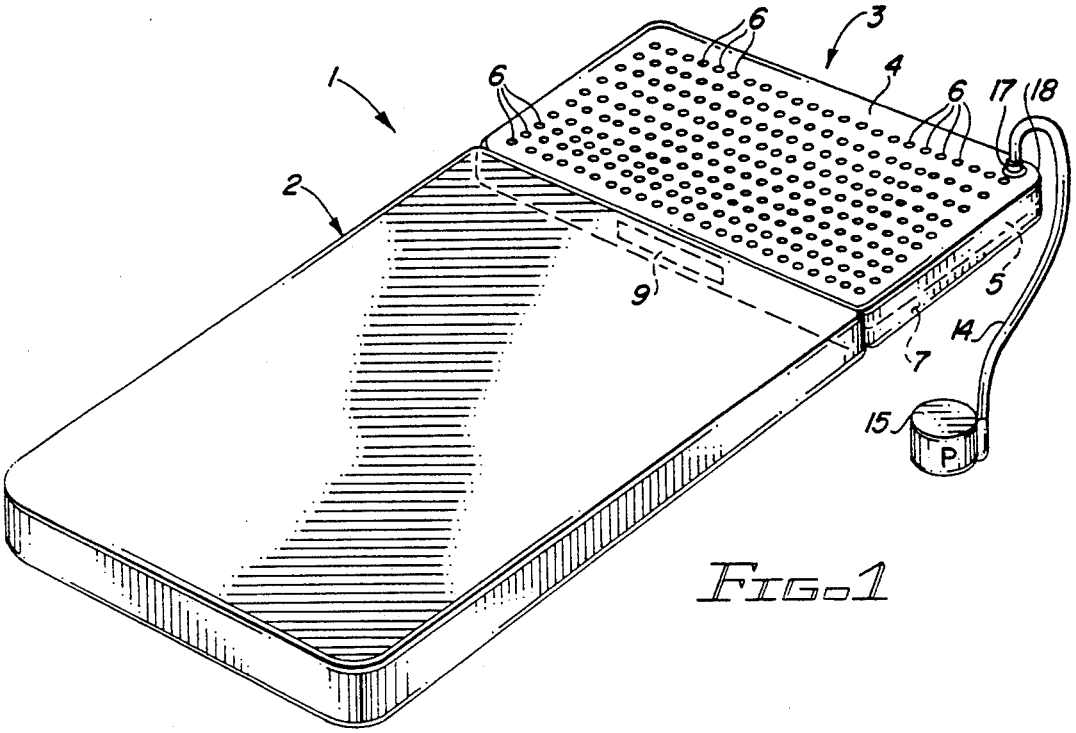
FIG. 1 is a perspective view of the body support pad of the present invention.
Figure 2:
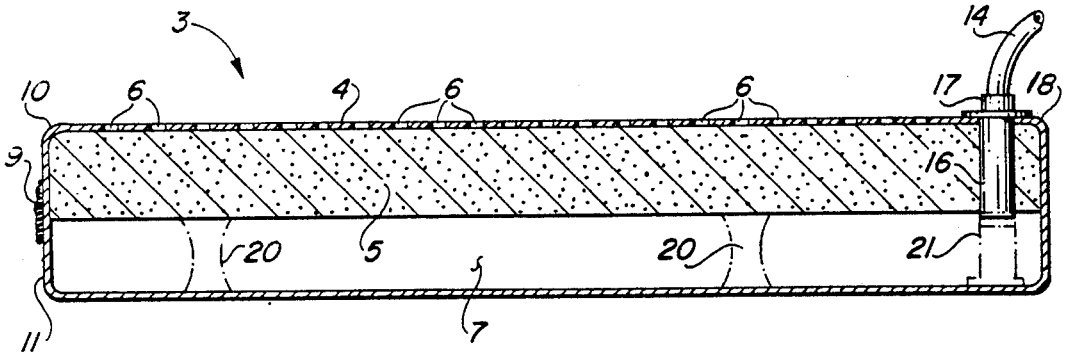
FIG. 2 is a sectional view showing the pillow portion of the body pad of FIG. 1.

With reference now to the figures, FIGS. 1 and 2 show body support pad 1 for use as a body support pad for an infant lying thereon. The body support pad 1 is designed to not only support the infant lying thereon, but also supply air flow to the infant as well as remove any carbon dioxide or other expelled or objectionable gases from the area in close proximity to the infant's face and nose.

The body support pad 1 comprises a pad 2 for supporting the infant's body and a pillow 3 that not only provides support for the infant's head but includes the air breathing means for supplying a sufficient amount of breathing air to the area near the infant's face and nose. The breathing air supplied to the infant is preferably normal fresh air but may be oxygen enriched air, water vapor enriched (humidified) air or an air medicine mixture.

Referring to pad 2 in detail, pad 2 is preferably constructed of a covered oblong shape foam pad of sufficient length and width to support the infant's body lying thereon. The interior of the pad 2 is preferably comprised of a soft porous material enclosed by a thin cloth, plastic, rubber or an equivalent soft material. Although not necessary, it is desirable to form the body support pad 1 by having an end section of the pad 2 attached to an end section of the pillow 3 at 9. For example, it is contemplated that a strip of hook and loop type fastener, such as that sold under the Trademark VELCRO would be an ideal way to form a readily detachable connection between pad portion 2 and pillow portion 3. Of course, pad 2 could be formed of a shape other than oblong and be of different lengths and widths to conform to infant's of different sizes and weights.

The structure of the pillow 3 may be best understood with reference to FIG. 2. As illustrated in FIG. 2, the interior of pillow 3 comprises essentially two main portions, an upper portion 10 and a lower portion 11 that together form the pillow 3 of sufficient length and width to underlie the head of an infant.

The upper portion 10 of pillow 3 is preferably comprised of a porous foam material 5 that will allow purification as well as filtration of air passing therethrough. Upper portion 10 includes a covering or outer sheet 4 on the outer surface of the upper portion 10 as illustrated by FIG. 1. Outer sheet 4 is perforated and preferably includes a plurality of perforations 6 for allowing air passage to and from an air pocket 7 through the porous material and outer sheet 4. The size and number of perforations 6 included on the outer sheet 4 may vary depending upon the size and weight of the infant intending to use the body support pad 1. Perforations 6 are of a significant greater diameter than the pores or openings in a normal sheet or blanket. The reason for these enlarged perforations is to assure that ventilation will not be clogged by vomit or sputum from the infant.

Pillow portion 3 includes an air hole 17 at an end of the pillow 3 opposite the pad 3 for allowing air passage to and from an exterior air source like air pump 15. Air hole 17 comprises a hollow cylindrical tube or feed pipe 16 that extends downward from an outer corner 18 of pillow 3 through the outer sheet 4 and the porous foam material and opens into air pocket 7.

A low pressure air pump 15 is provided for supplying air flow to and from air pocket 7 through a conduit means 14 that is connected at one end to air pump 15 and to air hole 17 at the other end. The air is pumped by air pump 15 through the conduit means 14 to fill the void defining the air pocket 7. Positive circulation of the air through the air pocket 7 and up through the porous material and outer sheet 4 is effective in removing any latent air from around the infant's face and nose.

As an alternate mode of operation, air pump 15 may be configured as a vacuum pump. In this mode ambient air pressure forces air down through perforations 6 and the porous foam material into air pocket 7 and out to pump 15. To prevent atmospheric pressure from collapsing air pocket 7 in this mode, it is desirable to extend feed pipe opening 21 well below the bottom of the porous foam pad and into air pocket 7. This feed pipe extension will serve to maintain the integrity and shape of air pocket 7.

In addition, it is contemplated that spacers 20 or the like be included in the air pocket 7 for preventing the collapse of air pocket 7. The spacers so may be used to prevent the air pocket 7 from collapsing during either mode of operation or from any liquid obstruction from the infant.

The present invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What I claim is:

1. A pillow breathing aid means for supporting the head of an infant, supplying breathing air near the mouth and nose of said infant, and providing ventilation to the portion of the skin of said infant in contact with said pillow means comprising:

a thin pliable outer sheet portion having a lower surface and sidewall surfaces which are relatively impermeable and having an upper support surface which is relatively permeable to the passage of air;

said outer sheet portion enclosing an interior volume of sufficient length and width to fully underlie said head of said infant, said interior volume also being of sufficient overall thickness to support said head of said infant in a position of healthy repose;

said enclosed interior volume being further subdivided into upper and lower portions, said upper portion being formed of a porous foam material and said lower portion being a void defining an air pocket bounded on the bottom and sides by said lower surface and sidewall surfaces of said thin pliable outer wall portion, and on the top by said sheet of porous foam material;

air pump means for supplying steady breathing air flow to said air pocket, wherein:

said steady breathing air flow to said air pocket cause air to flow near said nose and mouth of said infant without any effort on the part of the infant.

2. The pillow breathing aid means of claim 1, wherein said relatively permeable upper support surface includes a plurality of small perforations for permitting easy passage of breathing air.

3. The pillow breathing aid means of claim 1, wherein said air pump means comprises:

a pressure pump capable of supplying sufficient initial air flow to fill said air pocket and sufficient air pressure to support the weight of the head of said infant while sufficiently maintaining said steady breathing air flow near the nose and mouth of said infant; and, conduit means for connecting said pressure pump to said air pocket.

4. The pillow breathing aid means of claim 3, wherein said upper support surface and said upper portion of porous foam material are pierced with aligned apertures and said conduit means comprises:

a flexible tubing portion connected at one end to said pressure pump;

a semi-rigid but pliable feed pipe portion for passing through said aligned apertures, said feed pipe opening at one end into said air pocket and connecting at the other end to said flexible tubing, wherein:

pressurized breathing air flows from said pressure pump, through said flexible tubing to the top of said feed pipe above said upper support surface, down through said feed pipe to said air pocket, up through said upper portion of porous foam material where it is filtered and purified, and further up through said upper support surface passing in and around the nose and mouth of said infant lying upon said pillow.

5. The pillow breathing aid means of claim 1, wherein said air pump means comprises:

a vacuum pump capable of removing sufficient air from said air pocket to cause a steady breathing air flow past the nose and mouth of said infant as ambient air flows downward to replace that removed from the air pocket; and, conduit means for connecting said vacuum pump to said air pocket.

6. The pillow breathing aid means of claim 5, wherein said upper support surface and said upper portion of porous foam material are pierced with aligned apertures and said conduit means comprises:

a flexible tubing portion connected at one end to said vacuum pump;

a semi-rigid but pliable feed pipe portion for passing through said aligned apertures, said feed pipe opening at one end into said air pocket and connecting at the other end to said flexible tubing and including means to prevent the restriction of air flow upon the application of a vacuum to said air pocket, wherein:

said ambient air flows from the atmosphere down past the nose and mouth of the infant, down through said upper support surface, down through said upper portion of porous foam material and into said air pocket, up through said feed pipe to said flexible tubing connected to the top of said feed pipe above said upper support surface, and through said flexible tubing to said vacuum pump to be expelled to the atmosphere, wherein:

said ambient air flow past the nose and mouth of the infant is sufficient to remove any expelled carbon dioxide without any effort from the infant and thus reducing the risk of suffocation.

7. The pillow breathing aid means of claim 6, wherein said means to prevent the restriction of air flow upon the application of a vacuum to said air pocket comprises:

an extended portion of said semi-rigid feed pipe passing through said air pocket to said lower surface of said thin pliable outer sheet portion wherein:

said extended portion serves to prevent the collapse of said sheet portion against said feed pipe thus assuring free air flow.

8. The pillow breathing means of claim 7, further including spacer means disposed in said air pocket for preventing the collapse of said air pocket.

9. A body support pad having a body support portion and pillow portion, said body support portion comprising a covered foam padding support connected to said pillow portion, said pillow portion providing breathing aid means for supporting the head of an infant, supplying breathing air near the mouth and nose of said infant, and providing ventilation to the portion of the skin of said infant in contact with said pillow portion, said pillow portion comprising:

a thin pliable outer sheet portion having a lower act and sidewall surfaces which are relatively permeable and having an upper support surface which si relatively permeable to the passage of air;

said outer sheet portion enclosing an interior volume of sufficient length and width to fully underlie said head of said infant even during infant tossing and turning, said interior volume also being of sufficient overall thickness to support said head of said infant in a position of healthy repose;

said enclosed interior volume being further subdivided into upper and lower portions, one above the other, with said upper portion being formed of a porous foam material and said lower portion being a void defining an air pocket bounded on the bottom and sides by said lower surface and sidewall surfaces of said thin pliable outer wall portion, and on the top by said sheet of porous foam material;

air pump means for supplying steady breathing air flow to said air pocket, wherein:

said steady breathing air flow to said air pocket causes air to flow past said nose and mouth of said infant without any effort on the part of the infant.

10. The body support pad of claim 9, wherein said relatively permeable upper support surface includes a plurality of small perforations for permitting easy passage of breathing air.

11. The body support pad of claim 9, wherein said air pump means comprises:

a pressure pump capable of supplying sufficient initial air flow to fill said air pocket and sufficient air pressure to support the weight of the head of said infant while sufficiently maintaining said steady breathing air flow past the nose and mouth of said infant; and, conduit means for connecting said pressure pump to said air pocket.

12. The body support pad of claim 11, wherein said upper support surface and said upper portion of porous foam material are pierced with aligned apertures and said conduit means comprises;

a flexible tubing portion connected at one end to said pressure pump;

a semi-rigid but pliable feed pipe portion for passing through said aligned apertures, said feed pipe opening at one end to said air pocket and connecting at the other end to said flexible tubing, wherein:

pressurized breathing air flows from said pressure pump, through said flexible tubing to the top of said feed pipe above said upper support surface, down through said feed pipe to said air pocket, up through said upper portion of porous foam material where it is filtered and purified, and further up through said upper support surface passing in and around the nose and mouth of said infant lying upon said pillow.

13. The body support pad 9, wherein said air pump means comprises:

a vacuum pump capable of removing sufficient air from said air pocket to cause a steady breathing air flow past the nose and mouth of said infant as ambient air flows downward to replace that removed from the air pocket; and, conduit means for connecting said vacuum pump to said air pocket.

14. The body support pad of claim 13, wherein said upper support surface and said upper portion of porous foam material are pierced with aligned apertures and said conduit means comprises:

a flexible tubing portion connected at one end to said vacuum pump;

a semi-rigid but pliable feed pipe portion for passing through said aligned apertures, said feed pipe opening at one end to said air pocket and connecting at the other end to said flexible tubing and including means to prevent the restriction of air flow upon the application of a vacuum to said air pocket, wherein:

said ambient air flows from the atmosphere down past the nose and mouth of the infant, down through said upper support surface, down through said upper portion of porous foam material and into said air pocket, up through said feed pipe to said flexible tubing connected to the top of said feed pipe above said upper support surface, and through said flexible tubing to said vacuum pump to be expelled to the atmosphere, wherein;

said ambient air flow past the nose and mouth of the infant is sufficient to remove any expelled carbon dioxide without any effort from the infant and thus reduce the risk of suffocation.

15. The body support pad of claim 14, wherein said means to prevent the restriction of air flow upon the application of a vacuum to said air pocket comprises:

an extended portion of said semi-rigid feed pipe passing through said air pocket to said lower surface of said thin pliable outer sheet portion wherein:

said extended portion serves to prevent the collapse of said sheet portion against said feed pipe thus assuring free air flow.

16. The body support pad of claim 15, further including spacer means disposed in said air pocket for preventing the collapse of said air pocket.

* * * * *

UNITED STATES PATENT AND TRADEMARK OFFICE

CERTIFICATE OF CORRECTION

PATENT NO. : 5,305,483
DATE : April 26, 1994
INVENTORS : CHARLES E. WATKINS

It is certified that error appears in the above-identified that said Letters Patent is hereby corrected as shown below:

On the title page, Item [54] and column 1, line 1, should read --INFANT BODY SUPPORT PAD PROVIDING AIR FLOW FOR BREATHING --.

Signed and Sealed this

Twenty-fifth Day of October, 1994

*Attest:*

Bruce Lehman

BRUCE LEHMAN

*Attesting Officer*

*Commissioner of Patents and Trademarks*